US007342476B2

(12) United States Patent
Fushimi

(10) Patent No.: US 7,342,476 B2
(45) Date of Patent: Mar. 11, 2008

(54) LEAKAGE TRANSFORMER

(75) Inventor: Tadayuki Fushimi, Tokyo (JP)

(73) Assignee: Sumida Corporation, Tokyo (JP)

( * ) Notice: Subject to any disclaimer, the term of this patent is extended or adjusted under 35 U.S.C. 154(b) by 203 days.

(21) Appl. No.: 11/133,210

(22) Filed: May 20, 2005

(65) Prior Publication Data

US 2005/0219030 A1 Oct. 6, 2005

Related U.S. Application Data

(62) Division of application No. 10/448,077, filed on May 30, 2003, now Pat. No. 6,933,821.

(30) Foreign Application Priority Data

May 31, 2002 (JP) ..... 2002-160619
May 23, 2003 (JP) ..... 2003-146715

(51) Int. Cl.
*H01F 5/00* (2006.01)

(52) U.S. Cl. ..... 336/200

(58) Field of Classification Search ..... 336/65, 336/83, 200, 232
See application file for complete search history.

(56) References Cited

U.S. PATENT DOCUMENTS 3,287,678 A 11/1966 Okamoto et al.
5,359,313 A * 10/1994 Watanabe et al. ..... 336/178
5,812,045 A 9/1998 Ishikawa et al.
2002/0093410 A1 7/2002 Nakayama et al.

FOREIGN PATENT DOCUMENTS

| | | | |
|---|---|---|---|
| EP | 0 430 145 A1 | | 6/1991 |
| JP | 5-299271 | | 11/1993 |
| JP | 6-124844 | | 5/1994 |
| JP | 2001-160517 | | 6/2001 |
| JP | 2002-075756 | * | 3/2002 |
| JP | 2002-75756 | | 3/2002 |
| JP | 2002-299134 | | 10/2002 |

* cited by examiner

*Primary Examiner*—Tuyen T. Nguyen
(74) *Attorney, Agent, or Firm*—Finnegan, Henderson, Farabow, Garrett & Dunner, L.L.P.

(57) ABSTRACT

This is a small-size transformer that is made easily. Two bobbins around which a secondary coil is wound insert into bobbin protrusions from the opening surface side of the first core whereby the two bobbins are positioned in a row. A coiling protrusion around which to wrap a primary coil is formed in the aforementioned first core. Part of the primary coil coils around the coil protrusion and the remainder is positioned and coiled in a groove of the aforementioned first core provided in the outer circumference of the two bobbins. A second core is positioned in a countering position to the opening surface of the aforementioned first core so as to cover the aforementioned three protrusions.

13 Claims, 9 Drawing Sheets

LEAKAGE TRANSFORMER

This is a division of application Ser. No. 10/448,077, filed May 30, 2003, now U.S. Pat. No. 6,933,821 which is incorporated herein by reference.

TECHNICAL BACKGROUND OF THE INVENTION

1. Technical Field of the Invention

The present invention concerns a leakage transformer that is particularly suited for use in a DC/DC inverter circuit comprising an illumination circuit for a backlight emitting electrical light in a display device such as, for example, a notebook PC.

2. Prior Art

A known, conventional transformer of this type (for example, Japanese Laid-Open Patent Application 2002-75756) comprises two superposed cores, and around multiple column-like posts facing from one core to the other are wound a primary coil and a secondary coil.

The transformer with the aforementioned structure is characterized as being small and thin, all coils are wrapped around the posts, and refined work is required to make them small transformers.

OBJECTIVES OF THE INVENTION

The present invention was created to resolve the problems found in conventional leakage transformers mentioned above, its objective being to make a leakage transformer whereby work can be done easily even when creating a small-sized transformer.

DISCLOSURE OF THE INVENTION

The leakage transformer related to the present invention is characterized as being outfitted with two bobbins around which a second coil is wound; a first core forming in an opening surface two protrusions to align in a row the aforementioned two bobbins and a coil protrusion for a primary coil; a primary coil of which a part is wrapped around the aforementioned coil protrusion with the remainder wrapped around the periphery of the aforementioned two bobbins; and a second core arranged to face the opening surface of the first core so as to cover over the aforementioned three protrusions.

The leakage transformer of the present invention is characterized in that a groove to mount the aforementioned primary coil is formed in the opening surface side of the aforementioned first core.

The leakage device related to the present invention is characterized in that a gap is formed between the aforementioned second core, and the two protrusions for a secondary coil and a primary coil formed in the aforementioned first core.

The leakage transformer of the present invention is characterized in that connecting components are formed in the row of bobbins aligned in the first core, and that positioning protrusions are formed at locations of the aforementioned first core that correspond to the aforementioned connecting components.

The leakage transformer of the present invention is characterized in that bobbins aligned in the aforementioned first core and the positioning protrusions are in mutual contact and both are secured in an engaged state.

The leakage transformer of the present invention is characterized as being outfitted with two bobbins around which a secondary coils is wound, a first core with two protrusions to align in a row the aforementioned two bobbins jutting from the bottom toward the opening side, a primary coil in the bottom surface part of the aforementioned first core coiled so as to go around the aforementioned two stem-like protrusions, and a second core arranged to face the opening surface of the first core so as to cover the aforementioned two protrusions.

In the leakage transformer of the present invention, the aforementioned primary coil is characterized as being positioned between the bottom surface of the aforementioned first core and the aforementioned bottom flanges in the aforementioned two bobbins.

The leakage transformer of the present invention is characterized in that a groove is formed in the aforementioned two protrusions from the foundation part to the bottom surface part by way of a staggered part.

The leakage transformer of the present invention is characterized as being outfitted with two bobbins around which are coiled a secondary coil, a first core with two protrusions to align in a row the aforementioned two bobbins jutting from the bottom toward the opening surface and wherein is formed a single pass groove forming a more or less elliptical line along the outer circumference part, a primary coil positioned and coiled in the aforementioned groove formed in the lower surface part of the aforementioned first core, and a second core positioned to face the opening side surface of the first core so as to cover the aforementioned two protrusions.

BRIEF DESCRIPTION OF THE FIGURES

FIG. 11 is an eye-level view depicting the coiled status of a secondary coil in a leakage transformer of the first embodiment of the present invention.

FIG. 12 is an eye-level diagram depicting a status wherein the second core is removed from the leakage transformer of the first embodiment of the present invention using reconfigured bobbins.

FIG. 13 is an eye-level diagram depicting the status of a leakage transformer with the second core removed related to the second embodiment of the present invention.

FIG. 14 is an eye-level view depicting the first core used in a leakage transformer of the second embodiment of the present invention.

EXPLANATION OF THE INVENTION

Figure 1:
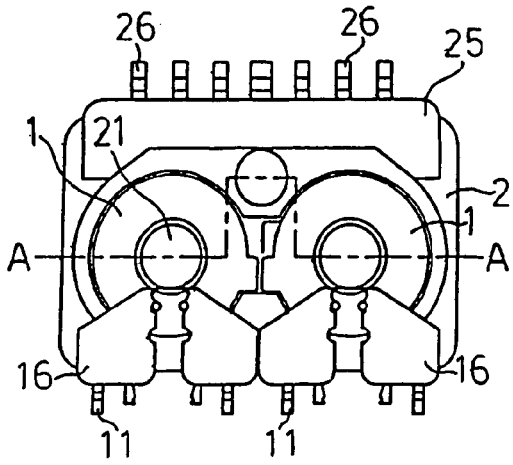
FIG. 1 is an eye-level diagram of a leakage transformer of the first embodiment of the present invention in a state wherein the second core is removed.
Figure 2:
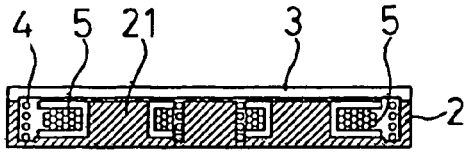
FIG. 2 is both a cross section along line A-A of the leakage transformer of FIG. 1 in a state wherein the second core is removed, as well as a cross section along line A-A of the leakage transformer of the present invention displayed in FIG. 9.
Figure 3:
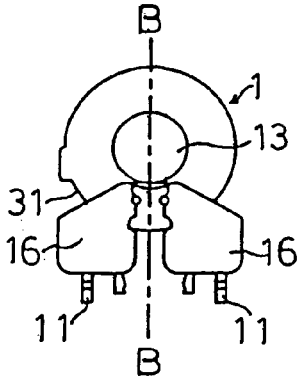
FIG. 3 is an eye-level view of a bobbin used in the leakage transformer of the first embodiment of the present invention.
Figure 4:
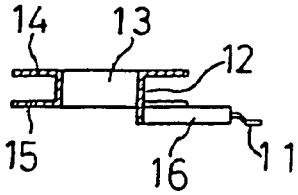
FIG. 4 is a cross section along line B-B of a bobbin used in a leakage transformer depicted in FIG. 3.
Figure 5:
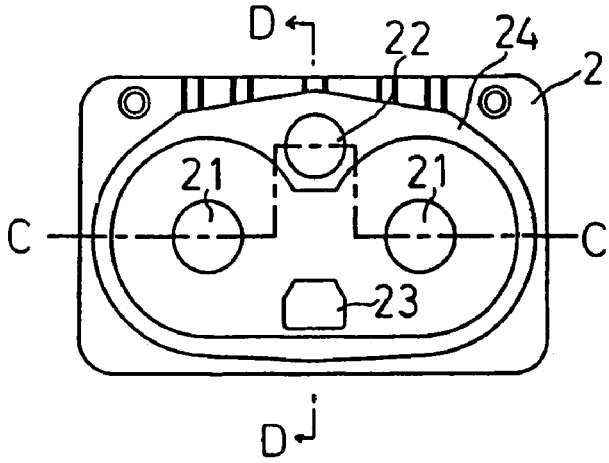
FIG. 5 is an eye-level view of a first core used in a leakage transformer of the first embodiment of the present invention.
Figure 6:
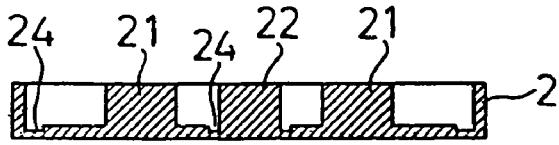
FIG. 6 is a cross section along line C-C of a first core used in a leakage transformer depicted in FIG. 5.
Figure 7:
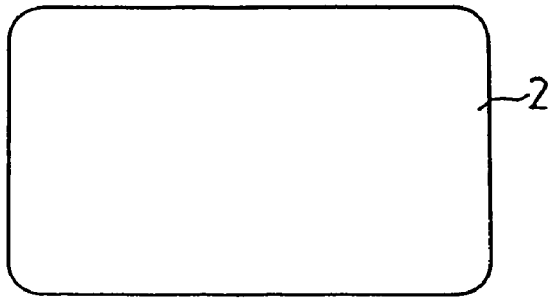
FIG. 7 is an eye-level view from the exterior of the first core used in the leakage transformer of the first embodiment of the present invention.
Figure 8:
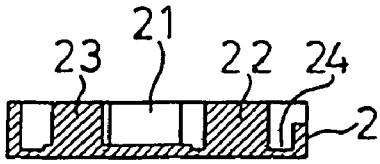
FIG. 8 is a cross section along line D-D of the first core used in the leakage transformer depicted in FIG. 5.

Embodiments of the leakage transformer of the present invention will be explained with reference to the subsequently attached figures. In the various diagrams, identical compositional elements are given identical code numbers, whereby repeated explanations are omitted. The leakage transformer of the first embodiment of the present invention uses two of the bobbins (1) depicted in FIG. 3 and FIG. 4. The two bobbins (1) are not exactly identical and, as shown in FIG. 1, are in a left-right symmetrical format. A secondary coil (5) is wound around these bobbins (1) as shown in FIG. 2. The bobbins (1) are provided with terminals (11) to which are connected the ends of the coil. Furthermore, the bobbins (1) are provided with a tube (12) around which a coil is wrapped, an upper flange (14) in the upper side of the tube (12) that juts outwardly, and a lower flange (15) in the lower side of the tube part (12) that juts outwardly. A hole (13) is formed in the center of the tube (12). The terminals (11) are provided so as to jut outwardly from terminal bases (16) that are planar and roughly trapezoidal. These terminal bases (16) are formed integrally with the bottom surfaces of the lower flanges (15) in the aforementioned bobbins (1).

FIG. 5 through FIG. 8 depict a first core (2). The first core (2) is planar and oblong. Formed in the opening surface where the bobbins (1) are provided are bobbin protrusions (21), (21) that insert into holes (3) in the bobbins (1) and that jut from the bottom surface, and also formed near the positions of the bobbins (1) are a coil protrusion (22) and a positioning protrusion (23) that face each other and that jut up from the bottom surface.

In the opening surfaces where bobbins (1) are to be placed is formed a groove (24) that follows a more or less elliptical line to provide a primary coil (4) and that makes a single pass around the periphery of the area where the two bobbins (1), (1) are to be placed. As FIG. 11 depicts, the primary coil (4) is wound so as to encircle the circumference of the two disposed bobbins (1), (1) and also to encircle the coil protrusion (22).

In a corner of the side of the first core where the coil protrusion (22) is formed is provided a terminal base (25) outfitted with a terminal (26) to which an end of the primary coil (4) is connected. The second core (3) is made in such a way as to face the first core (2) and its two provided bobbins (1), (1) and to cover the opening surface that exposes the bobbins (1), (1).

Figure 9:
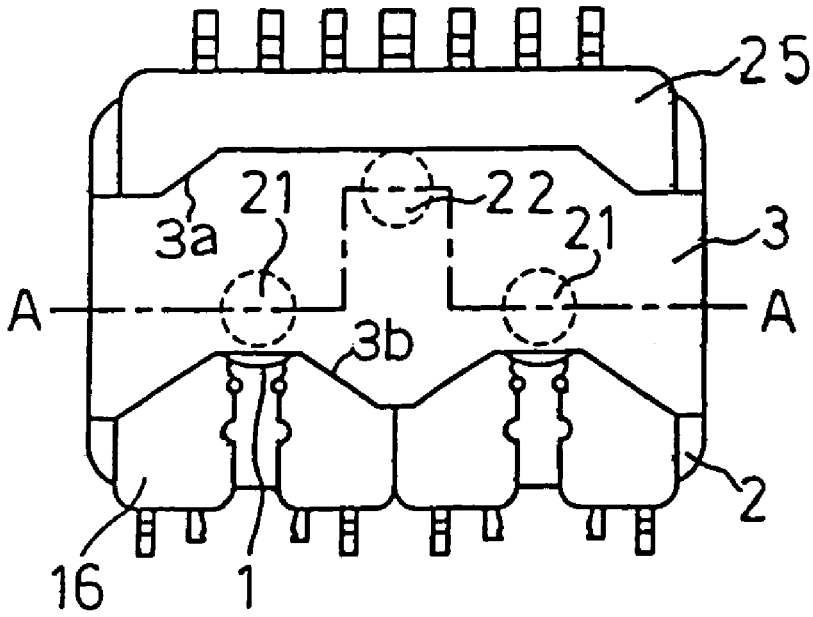
FIG. 9 is an eye-level view of the leakage transformer of the first embodiment of the present invention as seen from the second core side.

The second core (3) is a small, oblong plate and, as FIG. 9 depicts, the long sides (3*a*), (3*b*) have a zigzag form so as to connect to the insides of terminal bases (16) and terminal base (25) and are provided so as to be sandwiched between the aforementioned terminal base (16) and terminal base (25). The short sides of the aforementioned second core (3) are constructed so as to touch the short sides of the first core (2) and bind magnetically to said first core (2).

Furthermore, a magnetic gap is formed between the heads of the bobbin protrusions (21), (21) in the first core (2) and the heads of the coil protrusion (22) and the positioning protrusion (23), and the second core (3) positioned to face the opening surface of the first core (2). The width of this gap can be adjusted by changing the heights of the aforementioned bobbin protrusions (21), (21), the coil protrusion (22), and the positioning protrusion (23). In the present embodiment, the positioning protrusion (23) is formed so as to correspond more or less to the coil protrusion (22) and is meant to allow the bobbins (1), (1) to be positioned in prescribed locations of the opening surface of the first core (2). A notch (31) is made in the bobbins (1), (1) to connect to the aforementioned positioning protrusion (23).

Figure 10:
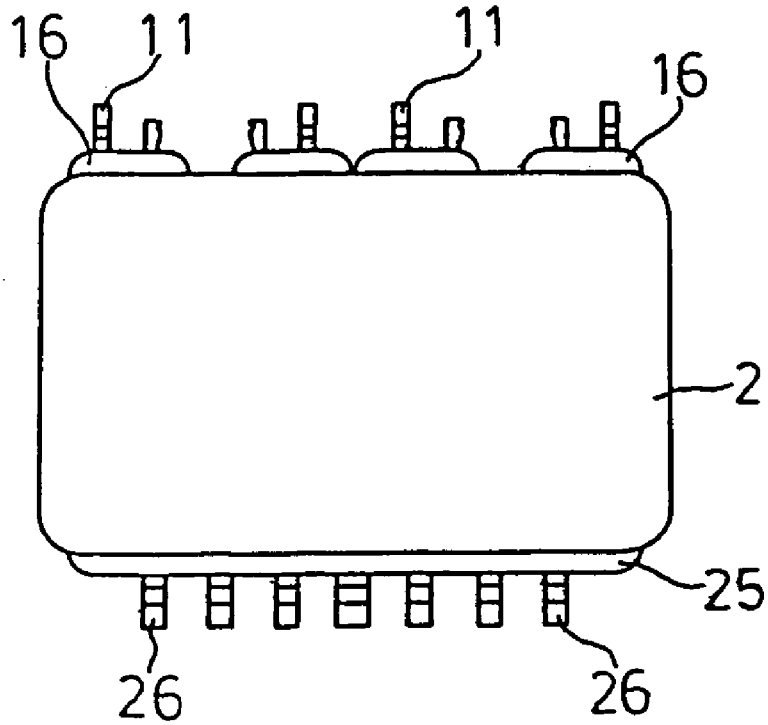
FIG. 10 is an eye-level view of the leakage transformer of the first embodiment of the present invention as seen from the first core side.
Figure 1:
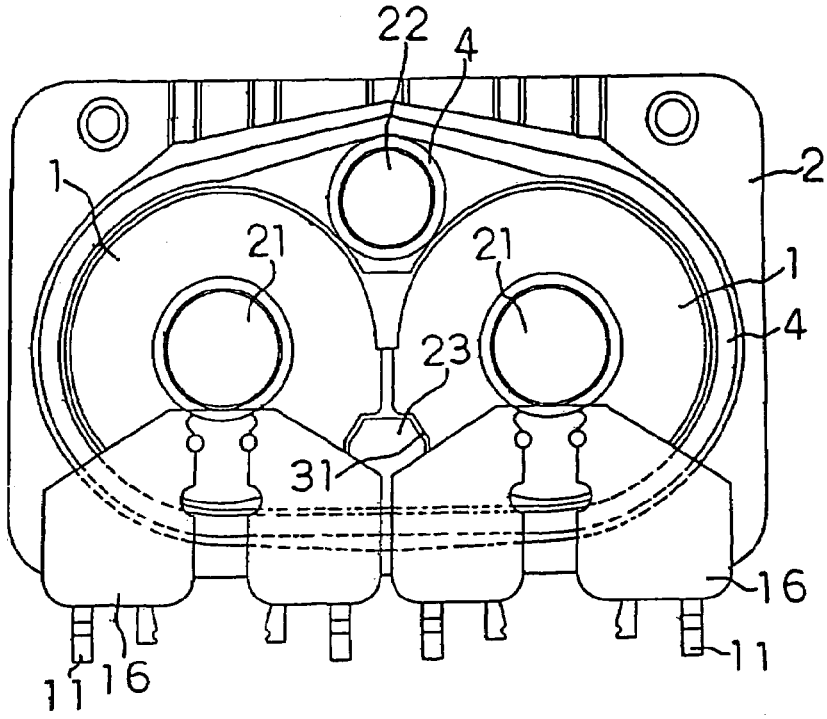
Figure 1:
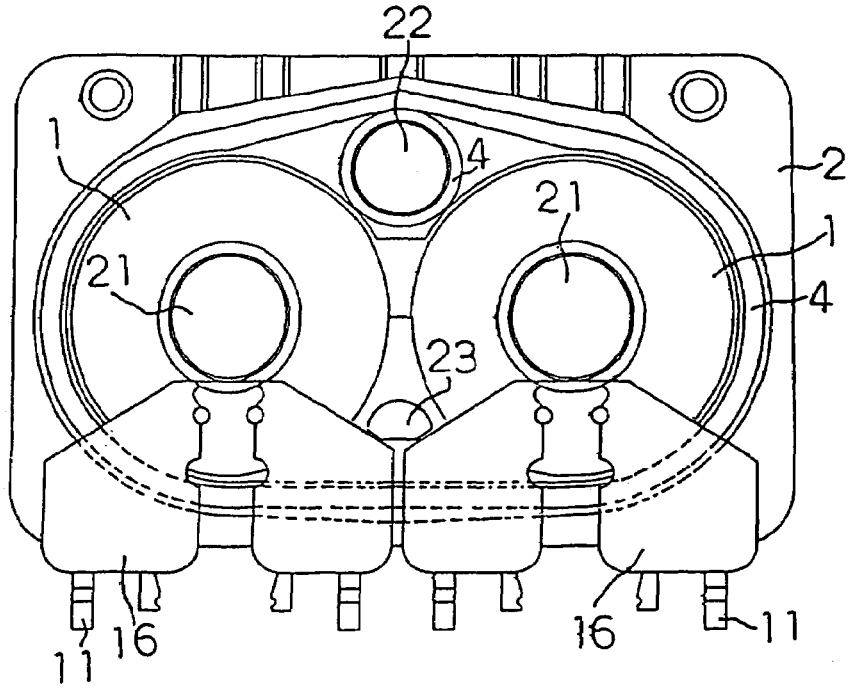
Figure 1:
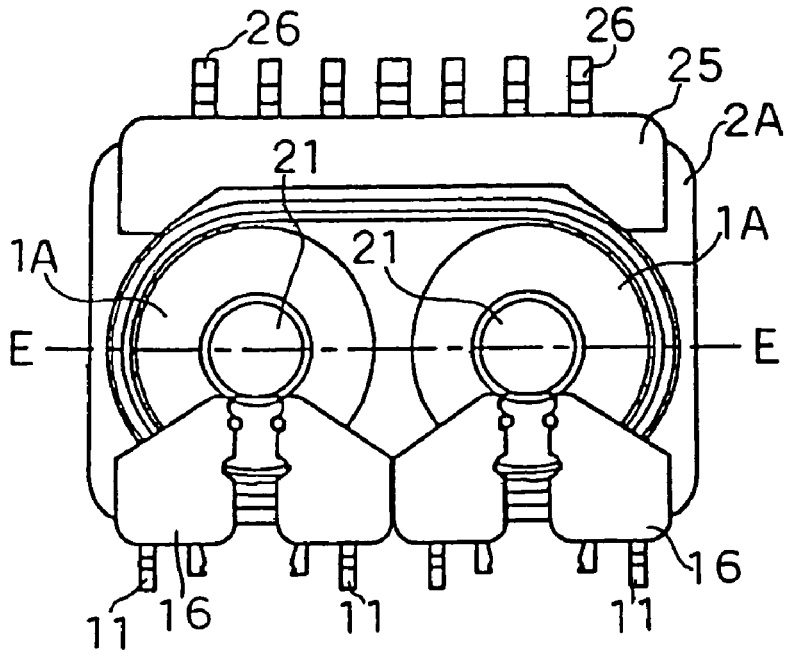
Figure 1:
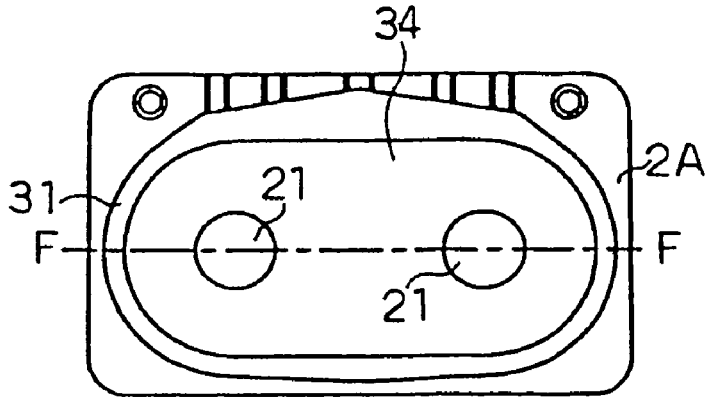

A leakage device constructed in the manner described above functions in the following manner. Two bobbins around which are wound a secondary coil (5) are prepared. As FIG. 1 depicts, a primary coil (4) is positioned in groove (24) in the first core (2) provided with a terminal base (25). Then, bobbin protrusions (21), (21) are inserted into holes (13) of the bobbins (1), (1) around which the aforementioned secondary coil (5) is wound whereby the bobbins (1), (1) are set in the first core (2). The status of FIG. 1 at this time is such that the bobbins (1), (1) are set upside-down with respect to their status in FIG. 4, as seen by the lower flange (15). When mounted on a print substrate or such, the outer surface of the first core (2) becomes the top side, as FIG. 10 depicts. Thus, the lower flange (15) ends up located on the bottom-most side facing the print substrate.

Thereafter, the unevenness formed in the long side (3*b*) of the second core (3) is connected to the interior end edges of the aforementioned terminal bases (16), (16) while the unevenness formed in the other long side (3*a*) is connected to the interior end edges of the aforementioned terminal base (25). In addition to these being joined by an adhesive or such, the first core (2) and the second core (3) are joined by an adhesive or such and are magnetically joined, thereby completing the leakage transformer.

With the leakage transformer of the first embodiment of the present invention, a secondary coil (5) is wound around bobbins, whereby the secondary coil (5) can be included by setting these bobbins (1) in a first core (2), leading to outstanding manufacturability. Also, by placing and winding the primary coil (4) in a groove (24) in the first core (2), a primary coil (4) can be included, leading to outstanding manufacturability. Furthermore, the second core (3) is put on the first core (2) as a lid to cover the opening side exposing the bobbins (1), (1) and the leakage transformer can be made in a simple manner by binding the first core (2) and the second core (3), whereby transformers can be made easily. The leakage transformer is made using two bobbins (1), (1) encircled by a secondary coil and outfitted with terminals (11) to which are connected the coil ends, and thus production can occur extremely easily. A leakage transformer of the invention of the present application using two bobbins (1) as discussed above is optimum to employ when the illuminating lamp involved has multiple lights. In short, the use of two bobbins (1) means there are two secondary coils that are provided apart from each other to supply power to two lamps. This implies, therefore, that a single leakage transformer of the present invention can cope with two lamps, and this at a time when the backlighting for liquid crystal display devices in notebook PCs and such involves multiple lighting.

As discussed earlier, moreover, a magnetic gap is formed in the space between the inner surface of the second core (3), the heads of the bobbin protrusions (21), (21), and the heads of the coil protrusion (22) and the positioning protrusion (23). The width of this gap can be adjusted by the height of the aforementioned bobbin protrusions (21), (21), the coil protrusion (22), and the positioning protrusion (23), whereby the coupling coefficient can be changed as appropriate.

Furthermore, adjustment of the degree of binding can be adjusted by the number of loops in the primary coil wound around the coil protrusion (22). Moreover, it is suitable to form protrusions in the inner surface of the second core (3) to face the bobbin protrusions (21), (21), the coil protrusion (22), and the positioning protrusion (23) in such a way as to make a magnetic gap between the protrusions. Furthermore, by winding the positioning protrusion (23) around such that the primary coil makes a continuous circle around the periphery, the degree of binding of the first core (2) and the second core (3) can be changed.

In addition, a notch (31) for connecting with the positioning protrusion (23) is made in the bobbins (1), (1) in the aforementioned embodiment. However, as FIG. 12 depicts, it is also suitable if no notch (31) is formed in the bobbins (1), (1), flat side edges are provided, and a light notch is made in apposition corresponding to the positioning protrusion (23). The flat sides edges of the aforementioned bobbins (1), (1) abut the notch of the positioning protrusion (23), whereby both are set in an engaged state.

Figure 15:
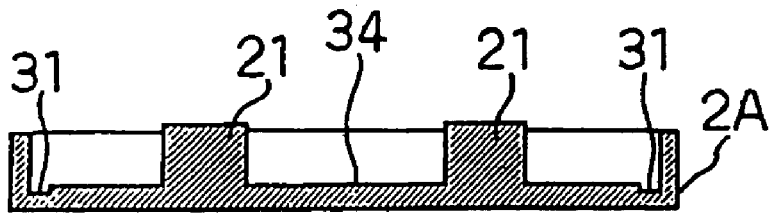
FIG. 15 is a cross section along line F-F of the first core used in the leakage transformer depicted in FIG. 14.
Figure 16:
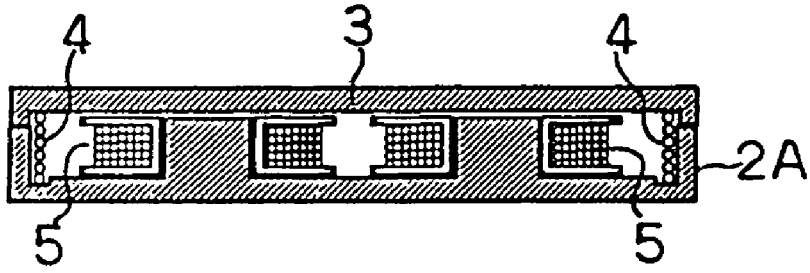
FIG. 16 is a cross section of the removed second core status in the cross section along line E-E of FIG. 13.

FIG. 13 is a second embodiment of a leakage transformer with the second core (3) removed. As FIG. 14-16 depict clearly, the first core (2A) comprising this leakage transformer is planar and roughly square, with two protrusions (21), (21) jutting forth from the bottom surface to the opening side. Formed in the opening side of the first core (2A) is a groove (31) tracing a more or less elliptical line once around the outer circumference. The bottom surface of this groove (31) is on a lower plane than the bottom surface (34) of the base peripheries of the two protrusions (21), (21). The coil protrusion (22) and positioning protrusion (23) formed in the first core (2) of the leakage transformer of the first embodiment are not provided in the first core (2A).

Bobbins (1A), (1A), around which is wound a secondary coil (5), are positioned in a row in the aforementioned two protrusions (21), respectively. Other than the fact that the eye-level views of the upper flange (14) and the lower flange (15) are rounded, these bobbins (1A), (1A) have the same structure as the bobbin (1) in FIG. 3 and FIG. 4.

Other than the structure explained above, the leakage transformer of the second embodiment has the same structure as that of the first embodiment. The leakage transformer of the second embodiment is made in the following manner. Two bobbins (1A) around which a secondary coil (5) is wrapped are prepared. As FIG. 13 depicts, a primary coil (4) is positioned in the groove (31) of the first core (2A) provided with a terminal base (5) and around which a primary coil (4) is wound. Then, the bobbin protrusions (21), (21) are inserted into holes (13) in the bobbins (1A), (1A) around which the aforementioned secondary coil (5) is provided. Whereby the bobbins (1A), (1A) are set into the first core (2A). The status depicted by FIG. 13 results, and the lower flanges (15) of the bobbins (1A), (1A) can be seen.

Then, just as in the first embodiment depicted by FIG. 9, the zigzags formed in the long side (3*b*) of the second core (3) are connected to the inner side edges of the aforementioned terminal bases (16), (16). Meanwhile, the zigzags formed in the other long side (3*a*) are connected to the inner side edges of the terminal base (25). These are joined together by an adhesive, etc. Furthermore, the first core (2A) and second core (3) are bound by adhesives, etc. and are also joined magnetically, thereby completing the leakage transformer.

The same outcome as the first embodiment can also be obtained with the leakage transformer of this second embodiment. Since no coil protrusion (22) or positioning protrusion (23) exist in the first core (2A) adopted in the leakage transformer of the second embodiment, the first core (2A) is easy to manufacture, and the work of coiling the secondary coil (2) becomes easy.

Figure 17:
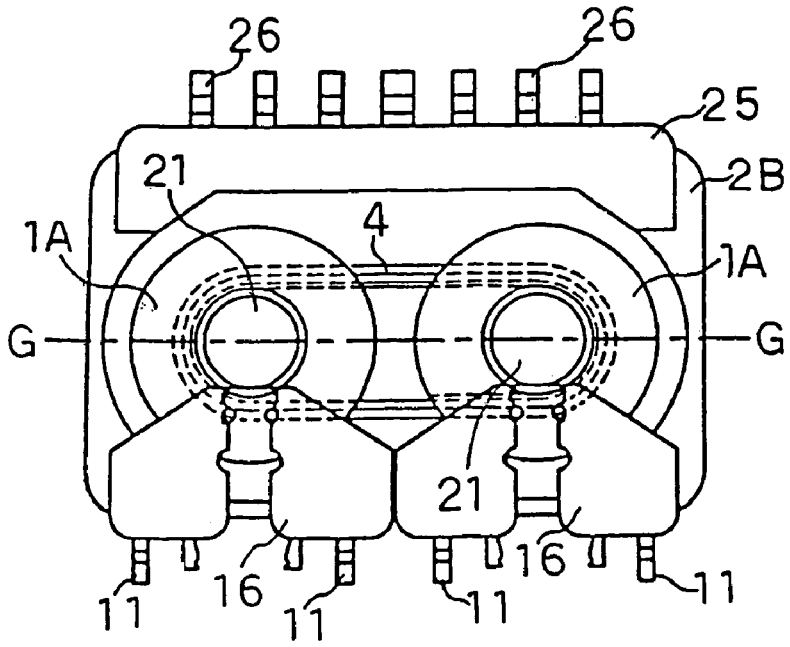
FIG. 17 is an eye-level view depicting the removed second core status in a leakage transformer of the third embodiment of the present invention.
Figure 18:
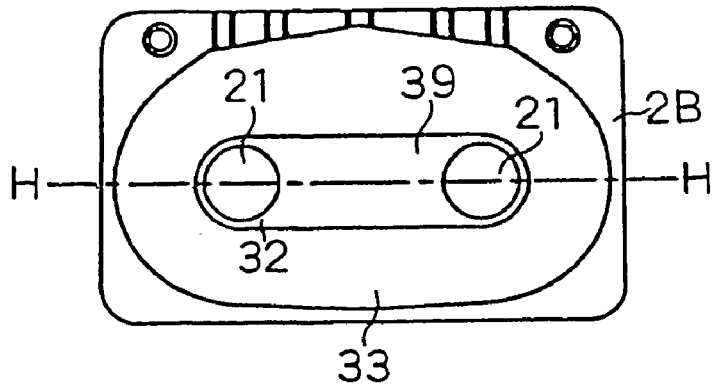
FIG. 18 is an eye-level view of the first core used in the leakage transformer of the third embodiment of the present invention.
Figure 19:
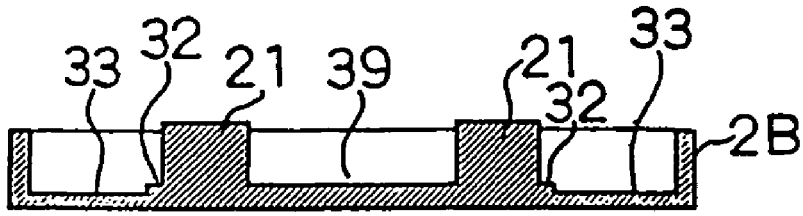
FIG. 19 is a cross section along line H-H of the first core used in the leakage transformer depicted in FIG. 18.

FIG. 17 depicts a status wherein the second core (3) is removed in the third embodiment of the leakage transformer. As FIGS. 18~20 clearly depict, the eye-level configuration of the first core (2B) comprising this leakage transformer is basically square, and two protrusions (21), (21) are formed that jut forth from the bottom surface to the opening surface side. Formed in the foundations of these protrusions (21), (21) are staggered components (32). The staggered components comprise bases that connect the space between the foundations of the two protrusions (21), (21). The bottom surfaces one level down from the aforementioned staggered components become a groove (33). Putting it differently, a groove (33) is formed in the bottom surfaces forming a link from the foundations in two protrusions (21), (21) by way of the staggered components (32).

Figure 20:
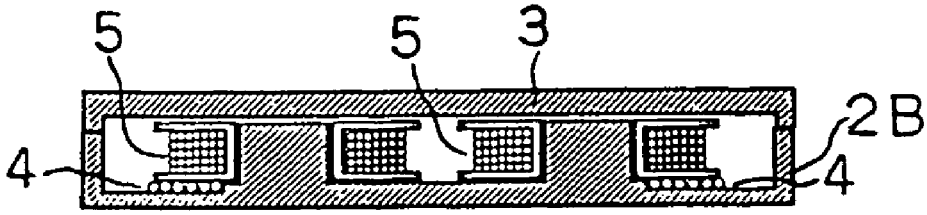
FIG. 20 is a cross section figure depicting the removed second core status in the cross section along line G-G of FIG. 17.

The primary coil (4) is wrapped going around the stems formed by the staggered components (32), (32) formed in the foundations of the aforementioned two protrusions (21), (21) in the bottom surface area of the first core (2B). Further, as FIG. 20 depicts, the primary coil (4) is provided in the gap between the aforementioned groove (33) and the upper flange (14) in the two bobbins (1A), (1A). The first core (2B) is not provided with the coil protrusion (22) and positioning protrusion (23) formed in the first core (2).

Other compositions in this third leakage transformer are identical to the leakage transformer structure associated with the second embodiment. The leakage transformer associated with this third embodiment is made in the same manner as the leakage transformer associated with the second embodiment, with the exception of coiling of the primary coil (4) around the stems comprised by the staggered components (32), (32) formed in the foundations formed by the two protrusions. The leakage component of the leakage transformer associated with this third embodiment also had an identical outcome to that of the second embodiment.

Figure 21:
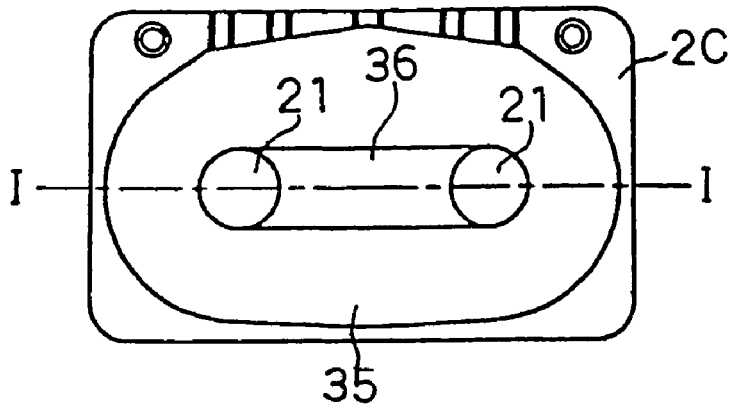
FIG. 21 is an eye-level view diagram of the first core used in the leakage transformer of a variant of the third embodiment of the present invention.
Figure 22:
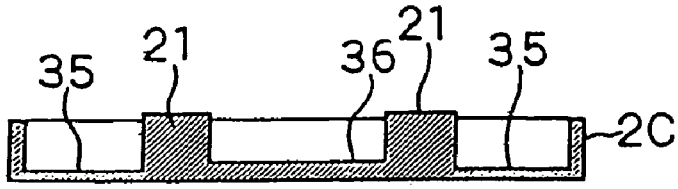
FIG. 22 is a cross section along line I-I of the first core depicted in FIG. 21.
Figure 23:
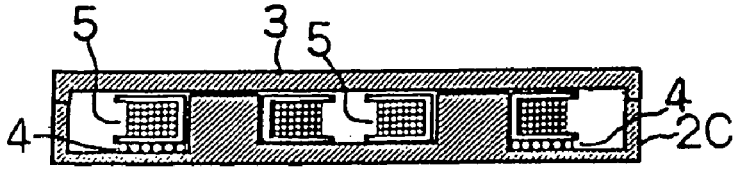
FIG. 23 is constructed using the first core of FIG. 21 and is a cross section along line G-G of the leakage transformer of FIG. 17 with the second core removed.

FIG. 21 and FIG. 22 depict a first core (2C) adopted in a variant of the third leakage transformer. A single-circle groove (35) drawing a more or less elliptical line along the outer circumference part of this first core (2C) is made, and the bottom surface of this grooves (35) is on a lower plane than the band shaped lower surface part (36) linking the foundations of the two protrusions (21), (21). As FIG. 23 depicts, the primary coil (4) is arranged between the upper flange (14) and the aforementioned groove (35) in the two aforementioned bobbins (1A), (1A). Other than the fact that the primary coil (4) is placed in and coiled around the aforementioned groove (35) formed in the lower part of the two protrusions (21), (21), the leakage transformer related to this third embodiment variant is made in the same way as the leakage transformer related to the third embodiment itself. The leakage transformer of this variant also has the same outcome as the third embodiment.

As explained above, the leakage transformer of the present invention is made by mounting two bobbins around which is wound a secondary coil onto protrusions jutting up from the bottom surface of a first core, and thus the transformer can be made extremely easily. Furthermore, because the primary coil is wound around the circumference of the aforementioned two bobbins and arranged in a groove provided in the lower part, the groove becomes a space for a coil, whereby making a large-sized transformer becomes avoidable.

The invention claimed is:

1. A leakage transformer comprising:

two bobbins;

a secondary coil wrapped around each bobbin;

a first core having an open side, a bottom side, and two protrusions that extend to the open side from the bottom side to align the two bobbins in a row;

a primary coil that wraps around the two protrusions in an encircling manner; and a second core arranged to face the open side of the first core in such a manner as to cover the two protrusions.

2. The leakage transformer of claim 1 wherein:

each bobbin includes a lower flange; and the primary coil is positioned between the bottom side of the first core and the lower flanges of the two bobbins.

3. The leakage transformer of claim 1 further including:

a component connecting lower parts of the protrusions to one another, and a groove formed in the bottom side of the first core surrounding the component connecting the lower parts of the protrusions to one another.

4. The leakage transformer of claim 1, wherein each bobbin includes an upper flange, a lower flange, and a hole extending between the upper flange and the lower flange.

5. The leakage transformer of claim 4, wherein the protrusions are inserted into the respective holes of the bobbins, and the bobbins are removable from the respective protrusions.

6. The leakage transformer of claim 1, further including a groove formed on the bottom side of the first core.

7. The leakage transformer of claim 6, further including:

a component connecting lower parts of the protrusions to one another; and a bottom surface of the groove is on a lower plane than a top surface of the component connecting the lower parts of the protrusions to one another.

8. The leakage transformer of claim 6, wherein the groove is elliptical.

9. The leakage transformer of claim 1, wherein the primary coil is wrapped directly onto the two protrusions.

10. The leakage transformer of claim 9, further including a component connecting lower parts of the protrusions to one another, the primary coil being wrapped directly onto the component connecting the lower parts of the protrusions to one another.

11. The leakage transformer of claim 1, wherein the first core includes only two protrusions.

12. A leakage transformer comprising:

two bobbins, each bobbin including an upper flange, a lower flange, and a hole extending between the upper flange and the lower flange;

a secondary coil wrapped around each bobbin;

a first core having an open side, a bottom side, and only two protrusions that extend to the open side from the bottom side to align the two bobbins in a row, the protrusions being inserted into the respective holes of the bobbins, and the bobbins being removable from the respective protrusions;

a primary coil encircling the two protrusions;

a second core arranged to face the open side of the first core in such a manner as to cover the two protrusions;

a component connecting lower parts of the protrusions to one another; and an elliptical groove formed in the bottom side of the first core, a bottom surface of the groove being on a lower plane than a top surface of the component connecting the lower parts of the protrusions to one another.

13. The leakage transformer of claim 12, wherein the primary coil is positioned between the bottom side of the first core and the lower flanges of the two bobbins.

* * * * *